US005560789A

United States Patent [19]

Sainfort et al.

[11] Patent Number: 5,560,789

[45] Date of Patent: Oct. 1, 1996

[54] 7000 ALLOY HAVING HIGH MECHANICAL STRENGTH AND A PROCESS FOR OBTAINING IT

[75] Inventors: Pierre Sainfort; Philippe Gomiero, both of Grenoble, France

[73] Assignee: Pechiney Recherche, Paris, France

[21] Appl. No.: 392,229

[22] Filed: Feb. 22, 1995

[30] Foreign Application Priority Data

Mar. 2, 1994 [FR] France ..... 94 02612

[51] Int. Cl.[6] ..... C22F 1/04

[52] U.S. Cl. ..... 148/549; 148/550; 148/552; 148/690; 148/693; 148/694; 148/701; 148/417; 148/439; 420/532

[58] Field of Search ..... 148/549, 550, 148/552, 690, 693, 694, 701, 417, 439; 420/532

[56] References Cited

U.S. PATENT DOCUMENTS 4,345,951 8/1982 Coupry et al. ..... 148/550
4,747,890 5/1988 Meyer ..... 148/439
5,277,719 1/1994 Kuhlman et al. ..... 148/701

FOREIGN PATENT DOCUMENTS 1206354 6/1986 Canada .
0377779 7/1990 European Pat. Off. .

*Primary Examiner*—David A. Simmons
*Assistant Examiner*—Robert R. Koehler
*Attorney, Agent, or Firm*—Dennison, Meserole, Pollack & Scheiner

[57] ABSTRACT

AA 7000 series alloys having high mechanical strength and a process for obtaining them. The alloys contain, by weight, 7 to 13.5% Zn, 1 to 3.8% Mg, 0.6 to 2.7% Cu, 0 to 0.5% Mn, 0 to 0.4% Cr, 0 to 0.2% Zr, others up to 0.05% each and 0.15% total, and remainder Al. Either wrought or cast alloys can be obtained, and the specific energy associated with the DEA melting signal of the product is lower than 3 J/g.

24 Claims, 1 Drawing Sheet

7000 ALLOY HAVING HIGH MECHANICAL STRENGTH AND A PROCESS FOR OBTAINING IT

BACKGROUND OF THE INVENTION

The invention relates to alloys of the 7000 series having high mechanical strength obtained by conventional metallurgy and to a process for obtaining them.

Alloys having high mechanical strength in this group, in particular those having a high content of alloying elements, are generally prepared either by powder metallurgy or by powder deposition—see for example the applicant's application FR-A-2640644. However, these processes are complex, necessitate special installations and consequently lead to expensive products.

The patent EP-A 0241193 (example 1) also discloses high strength alloys belonging to the 7000 group and having relatively high mechanical tensile characteristics but which have been solidified under pressure in the form of bars (diameter 75 mm×100 mm) which are immediately hot extruded without preliminary homogenisation. It should be noted that these conditions are quite unusual, probably necessitate a vertical extrusion press and that this practice is undoubtedly unfavourable with regard to the strength of the container acting as a casting mould. Furthermore, this method is complex and the alloys thus obtained attain a yield stress of at most 768.1 MPa.

The applicants have therefore attempted to obtain Al-based alloys having high mechanical strength but having sufficient ductility and being relatively inexpensive, by conventional metallurgy.

The term conventional metallurgy refers to a process in which a solid product is obtained as the result of a mean solidification rate between liquidus and solidus <600° C./min and for which the solidified product is cooled roughly to the ambient temperature (<100°) before being subjected to the shaping operations and/or subsequent heat treatments on other tools.

This could be the process for the gravity or pressure casting of wrought products issuing from ingots or bars obtained by semi-continuous casting, the continuous casting of strips between rollers, etc.

The U.S. Pat. No. 5,221,377 also discloses alloys of the 7000 group which have high characteristics and are obtained by conventional metallurgy. However, to obtain these high mechanical characteristics, it is necessary to subject them to a complex artificial ageing process in three stages.

SUMMARY OF THE INVENTION

The products according to the invention contain (% by weight) from 7 to 13.5 Zn, from 1 to 3.8 Mg, from 0.6 to 2.7 Cu, from 0 to 0.5 Mn, from 0 to 0.4 Cr, from 0 to 0.2 Zr, others up to 0.05 each and 0.15 in total, remainder Al, and are characterised in that, in the quenched and artificially aged temper of the T6 or T651 or T652 type (according to the AA nomenclature), they have specific energy, associated with the melting peak, of lower than 3 J/g, and preferably lower than 2 J/g in absolute value on a differential enthalpic analysis (DEA) thermogram drawn up under predetermined conditions (see examples).

The alloy preferably has the following composition:

Zn from 9 to 13.5; Mg from 2 to 3.8, the other elements being identical and again more preferably:

from 7 to 11 Zn; 1 to 2.5 Mg; 1 to 2.7 Cu.

When the alloy is wrought, the specific energy values are lower than 2 J/g, and preferably 1 J/g in absolute value.

The alloys according to the invention which are wrought by hot rolling into thick plates have mechanical tensile characteristics (in the longitudinal direction in the treated temper)

$R_m$>630 Mpa

R0.2>600 MPa

A %≧7%

The alloys which are wrought by extrusion, forging or die stamping have the following mechanical tensile characteristics (longitudinal direction):

Rm>770 MPa

Rp0.2>750 MPa

A>2% and preferably

Rm>800 MPa

Rp0.2>MPa

A>2%

Depending on the problem posed, the alloys are obtained by conventional processes; however, to obtain sufficient ductility (>3%) the homogenisation and solution heat treatment operations have to be carried out very close to the melting temperature of the most meltable eutectic without giving rise to a liquid phase and for a period which is such that the majority of the soluble phases can be subjected to solution heat treatment. This is manifested by lower or very low specific energy, associated with the melting peak, on the enthalpic thermograms, as mentioned above.

The homogenisation and solution heat treatment operations are carried out in a temperature range of less than 10° C. from the melting temperature of the eutectic of the treated alloy and preferably at less than 5° C. from this temperature.

To avoid incipient melting of the alloy, it is preferable for the homogenisation and/or solution heat treatment operations to be carried out in temperature ranges in two isothermal stages at rising temperature.

The wrought alloys can be shaped by any process, for example rolling, but also forging, extrusion or die stamping or a combination of these various methods.

In the case of extrusion, it has been noted that good mechanical properties can be obtained even with fairly low extrusion ratios (cross section of the bar/cross section of the extruded product) ranging between 3 and 10.

BRIEF DESCRIPTION OF THE DRAWING FIGURE

FIG. 1 shows the thermogram obtained on an alloy treated by method A+C in Table 1 obtained on a PERKIN-ELMER DSC7 differential enthalpic analysis (DEA) apparatus with a heating rate of 20° C./min on a sample weighing 50 mg approximately.

DESCRIPTION OF THE PREFERRED EMBODIMENTS

Figure 1:
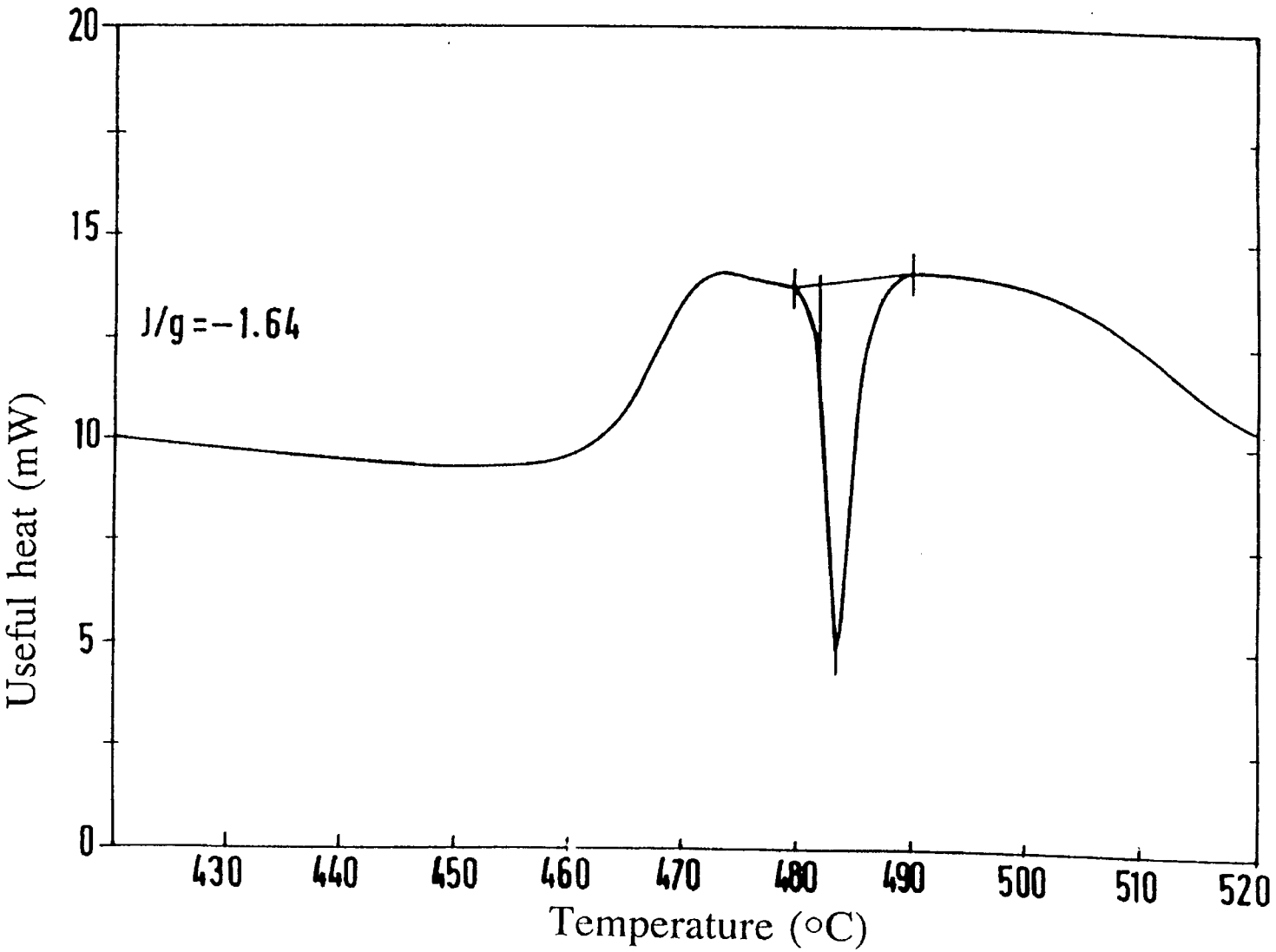

The invention will be better understood by means of the following examples, illustrated by FIG. 1.

Example 1

An Al alloy having the following composition by weight:

| Si | Fe | Cu | Mg | Zn | Ti | Zr | Mn | Cr |
|---|---|---|---|---|---|---|---|---|
| 0.04 | 0.055 | 0.92 | 2.84 | 10.7 | 0.03 | 0.10 | 0.2 | 0.13 |

was cast by conventional semi-continuous vertical casting in the form of bars having a diameter of 162 mm, cooled to ambient temperature then homogenised at 470° C. (±3° C.) for 48 h [A] or 470° C. (±3° C.) for 48 h +475° C. (+1, −2° C.) for 48 h [B], extruded at 400° C. after scalping in rods or flat parts solution heat treated at 474° C. (±2°) for 4 h [C] or 476° C. (±2° C.) for 4 h [D] quenched in cold water (=20° C.), stretched by 2% and artificially aged at 105° C. for 32 h.

An alloy having the same composition was treated in accordance with the prior art, that is by homogenisation for 24 h at 470° C. and solution heat treatment at 470° C. for 2 h, the other conditions remaining unchanged, by way of comparison.

The previously determined melting temperature of the eutectic of the alloy was 478° C.

The results of the mechanical characteristics in the longitudinal direction (averages of three samples) as well as the value of the specific melting energy are set out in Table 1.

TABLE 1

| Extruded Product (mm) | Homogenised Bars * | Extrusion Ratio | Solution Heat Treatment * | Long. Direction Rp 0.2 (MPa) | Rm MPa | A % | SE** |
|---|---|---|---|---|---|---|---|
| Dia. 60 | A | 4 | C | 775 | 790 | 2.7 | 1.64 |
| 42 × 27.5 | A | 11.6 | C | 794 | 819 | 3.6 | |
| Dia. 60 | B | 4 | D | 787 | 802 | 3.4 | 0.05 |
| 42 × 27.5 | B | 11.6 | D | 809 | 831 | 3.3 | |
| 42 × 27.5 | 24 h 470° | 11.6 | 2 h 470° | 730 | 746 | 3.0 | 5 |

*see text
**specific energy (absolute value)

Example 2

Two alloys $A_1$ and $A_2$ having the following composition by weight:

| | Si | Fe | Cu | Mg | Zn | Ti | Zr | Mn | Cr |
|---|---|---|---|---|---|---|---|---|---|
| $A_1$ | 0.05 | 0.08 | 1.7 | 2.2 | 8.3 | 0.03 | <0.01 | <0.05 | 0.2 |
| $A_2$ | 0.06 | 0.14 | 1.5 | 2.7 | 7.7 | 0.03 | <0.01 | <0.05 | 0.18 |

were cast in the form of slabs by conventional semi-continuous vertical casting, were homogenised for 48 h at 470° C., cooled to ambient temperature, hot-rolled into thick plates having a thickness of 20 mm (in the case of $A_1$) and 40 mm (in the case of $A_2$).

These plates were subjected to solution heat treatment at 474° C., were stretched by 2% and were subjected to an artificial ageing treatment, that is temper T651, for 24 h at 120° C.

Alloys of identical composition were treated by the prior art, that is homogenisation for 24 h at 470° C. and solution heat treatment for 2 h at 470° C., the other conditions being unchanged. The previously determined melting temperature of the eutectic of the alloys was 478° C.

The results of the mechanical characteristics (longitudinal direction) as well as the value of the specific melting energy are set out in Table 2.

TABLE 2

| Alloy | Homogenisation | Thickness mm | Solution heat treatment | R 0.2 MPa | $R_m$ MPa | A % | SE J/g |
|---|---|---|---|---|---|---|---|
| $A_1$ | 48 h - 470° C. | 20 | 474° C. | 615 | 652 | 12.2 | 0.2 |
| $A_2$ | id | 40 | 474° C. | 615 | 664 | 12.1 | 0.6 |
| $A_1$ | 24 h - 470° C. | 20 | 470° C. | 590 | 622 | 12.7 | 3. 2 |
| $A_2$ | id | 40 | 470° C. | 585 | 618 | 12.9 | 4.0 |

The alloys according to the invention are used, in particular, as powder propulsion units parts of missiles and weaponry structural stiffeners rails of aircraft seats aircraft wing panels.

What is claimed is:

1. A process for obtaining a high mechanical strength wrought alloy product, comprising the steps of casting a blank of an AA series 7000 aluminum alloy consisting essentially of, by weight, 9 to 13.5% Zn, 2 to 3.8% Mg, 0.6 to 2.7% Cu, 0 to 0.5% Mn, 0 to 0.4% Cr, 0 to 0.2% Zr, other elements up to 0.05% each and 0.15% total, and remainder Al, homogenizing the blank, hot transforming the homogenized blank, optionally cold transforming the homogenized blank, solution heat treating the transformed blank, and quenching and artificially aging the solution heat treated blank, said homogenizing and/or said solution heat treating being carried out at a temperature less than 10° C. below an incipient melting temperature for the alloy, whereby said wrought alloy product has a specific energy associated with a DEA signal less than 3 J/g in absolute value.

2. Process according to claim 1, wherein the specific energy is lower than 2 J/g in absolute value.

3. Process according to claim 1 wherein homogenizing and/or solution heat treating are carried out at less than 5° C. from the incipient melting temperature of the alloy.

4. Process according to claim 1, wherein homogenizing and/or solution heat treating are carried out in at least two successive stages at rising temperature.

5. Process according to claim 1 wherein hot transforming extrusion, forging or die stamping or a combination thereof.

6. Process according to claim 5 wherein said extrusion has an extrusion ratio between 3 and 10.

7. Process according to claim 1 wherein hot transformation is a rolling operation.

8. Process according to claim 1, wherein said wrought alloy product has a specific energy less than 2 J/g in absolute value.

9. Process according to claim 8, wherein said wrought alloy product has a specific energy less than 1 J/g in absolute value.

10. A process for obtaining a high mechanical strength cast alloy product, comprising the steps of casting a molded part of an AA series 7000 aluminum alloy consisting essentially of, by weight, 7 to 13.5% Zn, 1 to 3.8% Mg, 0.6 to 2.7% Cu, 0 to 0.5% Mn, 0 to 0.4% Cr, 0 to 0.2% Zr, other elements up to 0.05% each and 0.15% total, and remainder Al, solution heat treating the molded part, and quenching and artificially aging the solution heat treated molded part, said solution heat treating being carried out at a temperature less than 10° C. below an incipient melting temperature for the alloy, whereby said cast alloy product has a specific energy associated with a DEA signal less than 3 J/g in absolute value.

11. Process according to claim 10, wherein said cast alloy product has a specific energy less than 2 J/g in absolute value.

12. Process according to claim 11, wherein said cast alloy product has a specific energy less than 1 J/g in absolute value.

13. Process according to claim 10, wherein said solution heat treating is carried out at less than 5° C. from the incipient melting temperature.

14. Process according to claim 10, wherein said solution heat treating is carried out in at least two successive stages at rising temperature.

15. A high mechanical strength wrought alloy product, comprising an AA series 7000 aluminum alloy consisting essentially of, by weight, 9 to 13.5% Zn, 2 to 3.8% Mg, 0.6 to 2.7% Cu, 0 to 0.5% Mn, 0 to 0.4% Cr, 0 to 0.2% Zr, other elements up to 0.05% each and 0.15% total, and remainder Al, said alloy product being formed by casting a blank, homogenizing the blank, hot transforming the homogenized blank, optionally cold transforming the homogenized blank, solution heat treating the transformed blank, and quenching and artificially aging the solution heat treated blank, said homogenizing and/or said solution heat treating being carried out at a temperature less than 10° C. below an incipient melting temperature for the alloy, whereby said wrought alloy product has a specific energy associated with a DEA signal less than 3 J/g in absolute value.

16. Alloy product according to claim 15, wherein the specific energy is lower than 2 J/g in absolute value.

17. Alloy product according to claim 16 wrought by extrusion, forging or die stamping, having tensile mechanical characteristics in the longitudinal direction in T651 temper as follows:

Rm>770 MPa

Rp 0.2>750 MPa

A>2%.

18. Alloy product according to claim 17, having its tensile mechanical characteristics in the longitudinal direction in T651 temper as follows:

Rm>800 MPa

Rp 0.2>780 MPa

A>2%.

19. Alloy product according to claim 16, wrought by rolling, having its tensile mechanical characteristics in the longitudinal direction in T651 temper as follows:

$R_m$>630 MPa $R_{0.2}$>600 MPa

A>7%.

20. Alloy product according to claim 16 wherein the specific energy is less than 1 J/g in absolute value.

21. A high mechanical strength cast alloy product, comprising an AA series 7000 aluminum alloy consisting essentially of, by weight, 7 to 13.5% Zn, 1 to 3.8% Mg, 0.6 to 2.7% Cu, 0 to 0.5% Mn, 0 to 0.4% Cr, 0 to 0.2% Zr, other elements up to 0.05% each and 0.15% total, and remainder Al, said alloy product being formed by casting a molded part from said alloy, solution heat treating the molded part, and quenching and artificially aging the solution heat treated molded part, said solution heat treating being carried out at a temperature less than 10° C. below an incipient melting temperature for the alloy, whereby said cast alloy product has a specific energy associated with a DEA signal less than 3 J/g in absolute value.

22. Alloy product according to claim 21, containing from 7 to 11% Zn, from 1 to 2.5% Mg and from 1 to 2.7% Cu.

23. Alloy product according to claim 21, wherein the specific energy is less than 2 J/g in absolute value.

24. Alloy product according to claim 23, wherein the specific energy is less than 1 J/g in absolute value.

* * * * *